US007448942B2

(12) United States Patent
Miyazawa

(10) Patent No.: US 7,448,942 B2
(45) Date of Patent: Nov. 11, 2008

(54) GRINDING METHOD

(75) Inventor: Makoto Miyazawa, Okaya (JP)

(73) Assignee: Seiko Epson Corporation, Toyko (JP)

( * ) Notice: Subject to any disclaimer, the term of this patent is extended or adjusted under 35 U.S.C. 154(b) by 302 days.

(21) Appl. No.: 10/504,565

(22) PCT Filed: Feb. 13, 2004

(86) PCT No.: PCT/JP2004/001593

§ 371 (c)(1),
(2), (4) Date: Aug. 13, 2004

(87) PCT Pub. No.: WO2004/071707

PCT Pub. Date: Aug. 26, 2004

(65) Prior Publication Data

US 2005/0107008 A1 May 19, 2005

(30) Foreign Application Priority Data

Feb. 14, 2003 (JP) ..... 2003-036603
Dec. 9, 2003 (JP) ..... 2003-410312

(51) Int. Cl.
*B24B 1/00* (2006.01)

(52) U.S. Cl. ..... 451/41; 451/42

(58) Field of Classification Search ..... 451/41, 451/42

See application file for complete search history.

(56) References Cited

U.S. PATENT DOCUMENTS

| | | | | |
|---|---|---|---|---|
| 4,928,435 | A * | 5/1990 | Masaki et al. | 451/159 |
| 4,979,337 | A * | 12/1990 | Duppstadt | 451/550 |
| 5,074,082 | A * | 12/1991 | Cappelli | 451/42 |
| 5,577,950 | A * | 11/1996 | Smith et al. | 451/42 |
| 5,662,518 | A * | 9/1997 | James et al. | 451/384 |
| 6,110,017 | A | 8/2000 | Savoie et al. | |
| 6,155,911 | A * | 12/2000 | Mandler | 451/42 |
| 6,276,994 | B1 * | 8/2001 | Yoshida et al. | 451/41 |
| 6,383,061 | B1 * | 5/2002 | Mandler | 451/43 |
| 6,394,892 | B2 * | 5/2002 | Hanisch et al. | 451/259 |
| 6,527,632 | B1 * | 3/2003 | Dooley et al. | 451/504 |
| 6,796,877 | B1 | 9/2004 | Bingham et al. | |
| 6,932,678 | B2 * | 8/2005 | Toyoshima et al. | 451/42 |
| 6,945,849 | B2 * | 9/2005 | Miyazawa | 451/11 |
| 2004/0229553 | A1 * | 11/2004 | Bechtold et al. | 451/42 |
| 2005/0079812 | A1 * | 4/2005 | Bechtold | 451/504 |

FOREIGN PATENT DOCUMENTS

| | | | |
|---|---|---|---|
| DE | 10106007 | A1 | 2/2001 |
| JP | 55-164462 | A | 12/1980 |
| JP | 60-034261 | A | 2/1985 |
| JP | 10-175149 | A | 6/1998 |
| JP | 2000-177604 | A | 4/2000 |
| JP | 2002-263998 | A | 9/2002 |
| JP | 2003-275949 | A | 9/2003 |
| KR | 2001-108000 | | 12/2001 |

* cited by examiner

*Primary Examiner*—M. Rachuba
(74) *Attorney, Agent, or Firm*—Sughrue Mion, PLLC

(57) ABSTRACT

A surface to be polished having a plurality of surfaces of significantly different curvatures can be polished evenly by the use of resilient abrasive members by using a polishing method including the steps of selecting at least two resilient abrasive members 10*a*, 10*b* from the resilient abrasive members having a plurality of dome-shaped portions of different curvatures determined by a plurality of curvatures on the surface to be polished of the polishing target, and mounting the selected resilient abrasive members 10*a*, 10*b* to specific abrasive member mounting jigs 20*a*, 20*b* and polishing the surface to be polished of the polishing target L2.

6 Claims, 4 Drawing Sheets

GRINDING METHOD

TECHNICAL FIELD

The present invention relates to a polishing method and, more specifically, to a polishing method that enables accurate polishing of a surface to be polished having a plurality of surface portions of significantly different curvatures.

BACKGROUND ART

A concave surface (referred to also as eye-ball side, or inner surface) of a spectacle lens is formed into a shape such as a spherical surface, a rotationally symmetric aspheric surface, a toric surface, a progressive surface, or a curved surface formed of a combination thereof, and when the surface shape is machined, for example, by cutting, it is mirror-polished to an optical surface. For mirror polishing a simple curved surface, such as a spherical surface or a toric surface, face-up grinding using a rigid abrasive platter, which is called Oscar polishing, is used.

The mirror polishing method using the abrasive platter is a method for transferring the surface shape of the abrasive platter to the polishing target. Therefore, a number of, for example, thousands of, types of machining platters corresponding to the number of surface shapes according to the lens prescriptions are necessary. Since the abrasive platter cannot be used for polishing complex surfaces other than these surfaces, so-called, free surfaces, such as a progressive surface, a resilient abrasive member is generally used.

For example, the present inventor proposes a polishing method in which polishing is performed while bringing part of a dome-shaped portion of the resilient abrasive member, which is selected from among a plurality of resilient abrasive members having dome-shaped portions, larger than the concave surface to be polished, of the polishing target and having different curvatures according to the surface shape of the surface to be polished, into abutment with substantially the entire surface of the surface to be polished. In other words, the curvature of the resilient abrasive member is properly selected depending on the shape of the workpiece. The polishing step includes polishing while applying pressure on the inner surface of the dome-shaped hollow resilient sheet with pressurized fluid to give a tension to the dome-shaped portion, swinging and rotating the polishing target about its own axis, and rotating the resilient polishing member until substantial alignment of the center of curvature of the dome-shaped portion with the center of the swinging motion of the polishing target is achieved.

The resilient abrasive member is selected, for example, by the steps of obtaining $(R_{max}+R_{max})/2=R_{mid}$ from the largest radius of curvature $R_{max}$ (inverse number of curvature) and the smallest radius of curvature $R_{min}$ existing on the inner surface of the lens, and selecting a resilient abrasive member having a dome-shaped portion having a radius of curvature close to the intermediate radius of curvature $R_{mid}$. In the case of the astigmatic surface (toric surface), the radius of curvature of the resilient abrasive member is an intermediate value between the base curve and the cross curve, and hence a toric surface having a cylindrical surface can be polished evenly with the resilient abrasive member which comes into hermetic contact therewith with good followability with a minimum degree of deformation thereof. However, for example, in the case of a spectacle lens for correcting strong astigmatism, the difference in curvature between the base curve and the cross curve is significant.

When an addition power, which is the difference between powers of near and distance portion of a progressive multifocal lens, increases significantly, the difference in curvature between the distance portion and a near point increases significantly. Although the resilient abrasive member is superior in shape followability, in the case of the surface to be polished having a large difference in curvatures as described above, there may be a case in which some parts come into strong contact with such a surface and some parts come into poor contact with the same. Since the portion of poor contact cannot be easily polished, it requires a long time for polishing, while the portion of strong contact can be polished in a short time. Therefore, when an attempt is made to polish the portion of poor contact sufficiently, not only does it require a long polishing time, but it may result in so-called polishing sag, due to excessive polishing of the portion of strong contact. When trying to avoid polishing sag, the portion of poor contact may result in insufficient polishing.

Both polishing sag and insufficient polishing are defective polishing, and lowering of the yield and increasing the number of polishing steps due to the necessity of additional polishing have become problems. In view of such circumstances, it is an object of the present invention to provide a polishing method that can polish evenly a surface to be polished having a very large difference in curvatures evenly by the use of resilient polishing members.

DISCLOSURE OF INVENTION

A polishing method of the present invention is an improvement of a polishing method in the related art in which a surface to be polished of a polishing target including portions of significantly different curvatures is polished from the beginning to the end with a single resilient abrasive member, and employs a multi-stage polishing method in which polishing is performed by the use of at least two resilient abrasive members of different curvatures. In other words, it is a polishing method using a resilient abrasive member having dome-shaped portions, in which there are a plurality of types of resilient abrasive members of different curvatures, including steps of selecting at least two resilient abrasive members according to the surface shape of the surface to be polished, and polishing the surface to be polished by the use of selected resilient abrasive members.

According to such a multi-stage polishing method, the difference in curvature, which has previously been managed by a single resilient abrasive member, can be divided into a number of selected resilient abrasive members, and hence the difference in curvature which is to be managed by a single resilient abrasive member can be reduced. Therefore, more even polishing is achieved than the case of polishing by a single resilient abrasive member.

The plurality of resilient abrasive members each is assigned to a division corresponding to a predetermined curvature, respectively, so that the resilient abrasive member having the assigned curvature corresponding to the curvature of the division of the surface to be polished can be selected.

The plurality of divisions can be provided by dividing the surface to be polished having a plurality of curvatures according to the curvature ranging from the largest curvature to the smallest curvature.

The number of the resilient abrasive members is selected so as to polish the surface to be polished in two-stages, three-stages, or multi-stages including more than three stages. For example, the difference between the smallest curvature and the largest curvature of the surface to be polished is divided into a plurality of divisions, and the resilient abrasive member having a dome-shaped portion of a curvature close to the average curvature of the specific division can be selected for each divided division.

It is also possible to select a resilient abrasive member having a dome-shape portion of a curvature close to the largest curvature of the surface to be polished, a resilient abrasive member having a dome-shaped portion of a curvature close to the smallest curvature of the surface to be polished, and a resilient abrasive member having a dome-shaped portion of a curvature close to the average curvature between the largest curvature and the smallest curvature of the surface to be polished.

In addition to the usual resilient abrasive member, it is possible to select a resilient abrasive member having a dome-shaped portion of a curvature close to the curvature at the central area of the surface to be polished, which is most liable to be insufficiently polished.

Preferably, the polishing step includes polishing while rotating the polishing target about its own axis, rotating the resilient abrasive member about its own axis, and swinging the polishing target and the resilient abrasive member with respect to each other until substantial alignment of the center of curvature of the dome-shaped portion with the center of swinging motion of the polishing target is achieved. When the surface to be polished swings relatively, since the hermetic contact between the surface to be polished and the surface of the resilient abrasive member is maintained constant, the surface to be polished and the surface of the resilient abrasive member come into contact evenly with each other, whereby even polishing is achieved.

Preferably, the polishing method employs a resilient abrasive member whose dome-shaped portion is formed into a hollow dome shape, and includes a step of applying pressure to the inner surface of the resilient sheet to provide tension to the dome-shaped portion while polishing. Since adjustment of internal pressure of the resilient abrasive member is added to the conditions of polishing in comparison with the case in which the entire resilient abrasive member is formed of resilient material, adequate polishing can be carried out easily.

Therefore, the first aspect of the invention provides a polishing method using resilient abrasive members each having a dome-shaped portion, the resilient abrasive members being of a plurality of types having the dome-shaped portions of different curvatures, including the steps of selecting more than two of the resilient abrasive members according to the surface shape of the surface to be polished, and polishing the surface to be polished by the use of the selected resilient abrasive members.

The second aspect of the invention provides a polishing method according to the first aspect of the invention, characterized in that the plurality of resilient abrasive members each are assigned to one of the plurality of divisions corresponding to the predetermined curvatures, and the step of selecting includes selecting a resilient abrasive member having a curvature which corresponds to the curvature of the assigned division prior to the step of polishing a curvature of the surface to be polished.

The third aspect of the invention provides a polishing method according to the second aspect of the invention characterized in that the plurality of divisions are provided by dividing the surface to be polished having the plurality of curvatures according to the curvature ranging from the largest curvature to the smallest curvature.

The fourth aspect of the invention provides a polishing method according to the first aspect, characterized in that the step of selecting includes selecting resilient abrasion members having the dome-shaped portions of curvatures close to the average curvature of the respective divisions of the surface to be polished of a plurality of curvatures, which are divided according to the curvature ranging from the largest curvature to the smallest curvature.

The fifth aspect of the invention provides a polishing method according to the first aspect, characterized in that the step of selecting includes selecting a resilient abrasive member having the dome-shaped portion of a curvature close to the largest curvature of the surface to be polished, a resilient abrasive member having the dome-shaped portion of a curvature close to the smallest curvature of the surface to be polished, and a resilient abrasive member having the dome-shaped member of a curvature close to the average curvature between the largest curvature and the smallest curvature of the surface to be polished.

The sixth aspect of the invention provides a polishing method according to the first aspect, characterized in that the step of selecting includes selecting a resilient abrasive member having the dome-shaped portion of a curvature close to the curvature of the central area of the surface to be polished.

The seventh aspect of the invention provides a polishing method according to any one of the first to sixth aspects, characterized in that the step of polishing includes polishing while rotating the polishing target and the resilient abrasive member about their own axes, and swinging the polishing target and the resilient abrasive member with respect to each other until substantial alignment of the center of curvature of the dome-shaped member with the center of swinging motion of the polishing target is achieved.

The eighth aspect of the invention is a polishing method according to any one of the first to the seventh aspects, characterized in that the dome-shaped portion of the resilient abrasive member is formed into a hollow dome shape by the resilient sheet, and the step of polishing includes polishing while applying pressure to the inner surface of the resilient sheet with a pressurized fluid injected into the hollowed portion to provide tension to the dome-shaped portion.

BEST MODE FOR CARRYING OUT THE INVENTION

Figure 1A:
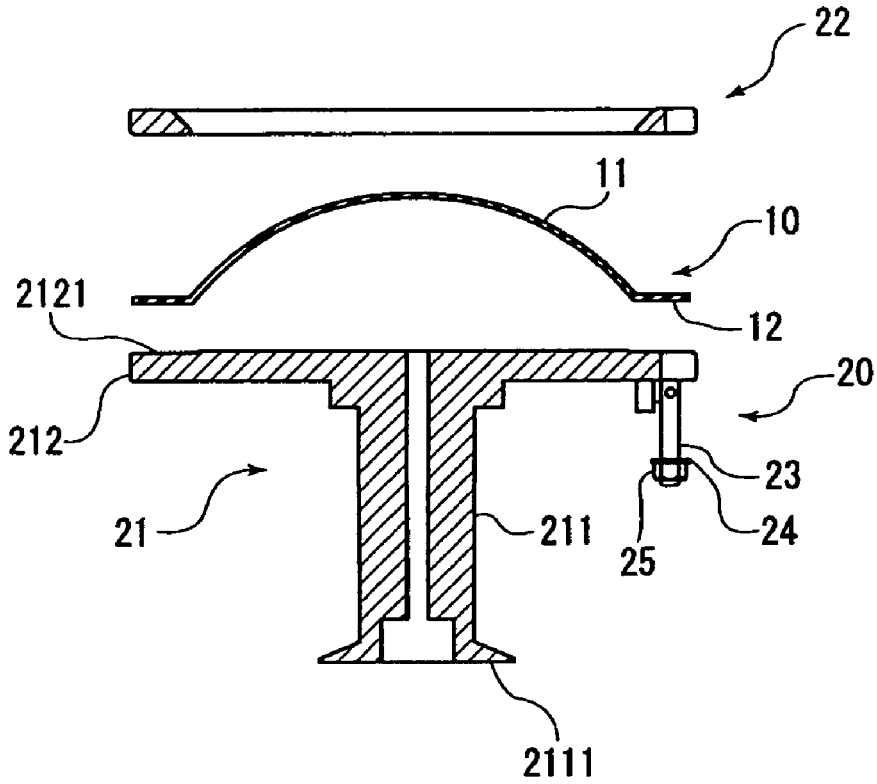
FIGS. 1A and 1B show a resilient abrasive member and an abrasive member mounting jig used for a polishing method and a polishing device according to an embodiment of the present invention, in which (a) is a cross-sectional view showing each component in a disassembled manner, and (b) is a top view showing a state in which the resilient abrasive member is mounted to the abrasive member mounting jig.

While embodiments of a polishing method according to the present invention will now be described, it is to be understood that the present invention is not limited to the following embodiments.

As described above, the polishing method according to the present invention is performed by selecting a plurality of resilient abrasive members having dome-shaped portions of different curvatures corresponding to the surface shape of the concave surface to be polished from among a plurality of resilient abrasive members having dome-shaped portions of different curvatures, and carrying out a step of polishing the surface to be polished using the selected resilient abrasive members.

The polishing target of the polishing method of the present invention is not specifically limited as long as it is relatively small in area and has a concave surface to be polished which requires mirror polishing. For example, in addition to optical lenses as typified by a camera lens, a telescope lens, a microscope lens, a condenser lens for a stepper, and a spectacle lens, it may be a glass mold for cast-polymerizing a plastic lens, or optical components as a cover glass for portable devices. Description will be made about a plastic spectacle lens below as an example.

A concave surface of a plastic spectacle lens (referred to also as eye-ball side, or inner surface) is formed with a spherical surface, a rotationally symmetric aspheric surface, a toric surface, a progressive surface, or a curved surface formed of a combination thereof. A convex surface on the other hand is formed with a spherical surface, a rotationally symmetric aspheric surface, a progressive surface, or the like. The shape of the concave surface is formed by cutting by numerical control or the like in many cases. After such cutting work, it is necessary to mirror polish to a desired optical surface.

A resilient abrasive member used in the present invention preferably has a dome-shaped portion having a larger area than the concave surface to be polished. Accordingly, polishing can be carried out by keeping the dome-shaped portion in contact with substantially the entire surface of the surface to be polished, and hence the polishing speed can be improved. By providing the surface area of the dome-shaped portion of the resilient abrasive member larger than the area of the surface to be polished, the peripheral velocity of the rotation of the resilient abrasive member about its own axis can be increased to improve the polishing speed, and the shape followability of the resilient abrasive member can be improved. The diameter of the dome-shaped portion of the resilient abrasive member is preferably 1.1–10 times, and more preferably, on the order of 1.5–5 times the diameter of the lens to be polished.

The dome-shaped portion can be obtained by forming the resilient sheet into a dome-shape and maintaining the dome shape by an inner pressure of a pressurized fluid, by forming the resilient material into a dome-shaped block, and by filling the hollow portion of the dome-shaped resilient sheet with another resilient material. The resilient sheet has a thickness preferably in the range from 0.1 to 10 mm and, more specifically, in the range from 0.2 to 5 mm, and preferably has properties: 10–100 in JIS A hardness (Type-A durometer), and $10^2$–$10^3$ $N*cm^{-2}$ in Young's modulus. The quality of the resilient sheet or the resilient material may be, for example, natural rubber, nitrile rubber, chloroprene rubber, styrene butadiene rubber (SBR), acrylonitrile butadiene rubber (NBR), silicon rubber, rubber such as fluorine fluorocarbon rubber, thermal plastic resin such as polyethylene and nylon, and thermal plastic resin elastomer such as styrene or polyurethane containing resin.

Figure 1B:
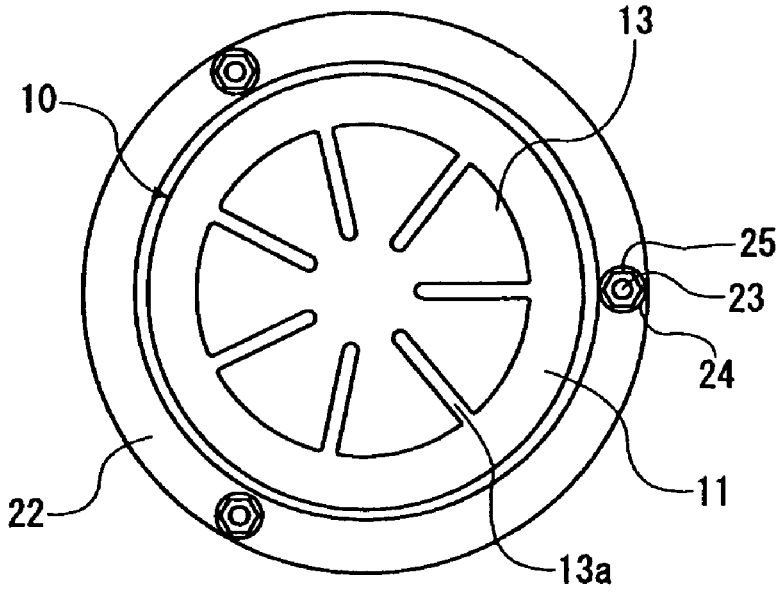

FIG. 1 shows an embodiment of a resilient abrasive member and an embodiment of an abrasive member mounting jig for holding the resilient abrasive member, in which (a) is an exploded cross-sectional view, and (b) is a top view showing a state in which the resilient abrasive member is mounted to the abrasive member mounting jig.

The resilient abrasive member 10 of this embodiment is formed of a resilient sheet, as shown in FIG. 1(*a*), and includes a hollow dome-shaped portion 11 formed into a dome shape, and a ring-shaped flange portion 12 provided integrally with the dome-shaped portion 11 around the peripheral edge thereof so as to project outward. An abrasive pad 13 formed of non-woven fabric cut out into the shape of flower petals, as shown in FIG. 1(*b*) for example, is adhered on the outer surface of the dome-shaped portion 11 with an adhesive or the like. The abrasive pad 13 has a function such as to hold abrasive fluid, and gaps 13*a* of the abrasive pad 13 function as passages for supplying abrasive grain or water, or for discharging ground waste. The shape of the abrasive pad 13 is not limited to the shape of flower petals, but the abrasive pads cut out into circular, oval, or polygonal shapes may be adhered densely.

The abrasive member mounting jig 20 holds the resilient abrasive member 10, forms a sealed space on the inner side of the resilient abrasive member 10, and functions as a flow path for introducing a pressurized fluid into the resilient abrasive member 10. In addition, it has a function to be mounted and fixed to a polishing device that will be described later.

The abrasive member mounting jig 20 has a mounting jig body 21 and a ring-shaped holding member 22. The mounting jig body 21 includes a cylindrical portion 211 shaped like a circular cylinder and a flange-shaped abrasive member mounting portion 212 formed integrally and coaxially with the cylindrical portion 211 at the outer periphery of the upper end thereof so as to extend in the direction orthogonal to the axis of the cylindrical portion 211. The abrasive member mounting portion 212 is provided at the upper periphery thereof with a ring-shaped shallow recess 2121 in which the flange portion 12 of the resilient abrasive member 10 is accommodated. The recess 2121 is formed with notches, not shown, at three locations at constant angular intervals around the center thereof. Bolts 23 are rotatably attached to the lower surface of the abrasive member mounting portion 212, so that the bolts 23 can be inserted into and detached from the notches. A washer 24 and a nut 25 are attached to the bolt 23. There are also provided notches, not shown, on the flange portion 12 of the resilient abrasive member 10 at the positions corresponding to these notches. The holding member 22 is ring-shaped, having a flat lower surface so that it can be accommodated in the recess 2121 formed on the abrasive member mounting portion 212, and is formed with notches, not shown, at the positions corresponding to the notches of the abrasive member mounting portion 212. The cylindrical portion 211 is formed with a tapered mounting portion 2111 to be mounted and fixed to the polishing device at the lower end thereof so as to project outward.

In order to fix the resilient abrasive member 10 to the abrasive member mounting jig 20, the flange portion 12 of the resilient abrasive member 10 is interposed and fixed between the abrasive member mounting portion 212 and the holding member 22, as shown in FIG. 1(*b*), by placing the flange portion 12 of the resilient abrasive member 10 in the recess 2121 of the abrasive member mounting portion 212 so as to align the notches with respect to each other, placing the holding member 22 on the flange portion 12 of the resilient abrasive member 10 so as to align the notches with respect to each other, and inserting the bolts 23 upright through the notches and tightening them with nuts 25. Consequently, a dome-shaped sealed space is defined between the inner surface of the dome-shaped portion 11 and the upper surface of the abrasive member mounting portion 212, and the sealed space communicates with the outside via a gap in the cylindrical portion 211.

Polishing is performed while applying pressure on the inner surface of the dome-shaped portion 11 with pressurized fluid to provide tension to the dome-shaped portion 11, pressing the dome-shaped portion 11 against the surface to be polished with a predetermined polishing pressure, swinging the polishing target and rotating the same about its own axis, and rotating the resilient abrasive member 10 until substantial alignment of the center of curvature of the dome-shaped portion 11 with the center of the swinging motion of the polishing target is achieved.

For the polishing method of the present invention, a plurality of resilient abrasive members 10 having the dome-shaped portions 11 of different curvatures is provided in advance. When the curvatures of the dome-shaped members 11 are different, the diameters of the dome-shaped members 11 are also different, and hence the diameters of the abrasive member mounting portions 212 for fixing the resilient abrasive member 10 are also different. As will be described later, since it is necessary to substantially align the center of the swinging motion and the center of the curvature of the dome-shaped portion 11, a specific abrasive member mounting jig 20 is used in combination with the respective resilient abrasive members 10 having the dome-shaped portions 11 of different curvatures.

When polishing the inner surface of a spectacle lens, the plurality of resilient abrasive members 10 having the dome-shaped portions 11 of different curvatures are assigned to the divisions within a range of the dome-shaped portion 11 between 40 mm and 600 mm, which is the range of the radius of curvature of the inner surface of the spectacle lens. More specifically, preferably, five to ten resilient abrasive members 10 having the dome-shaped portions 11 of different curvatures for every 10–40 mm, more preferably, for every 14–30 mm in the range up to 200 mm, and a plurality of the resilient abrasive members 10 for every 100–200 mm in the range between 200 mm and 600 mm are provided. The divisions described above may be divided so as to overlap the radius of curvature. Accordingly, they can cope with any shape of inner surfaces based on almost all prescriptions.

Figure 2:
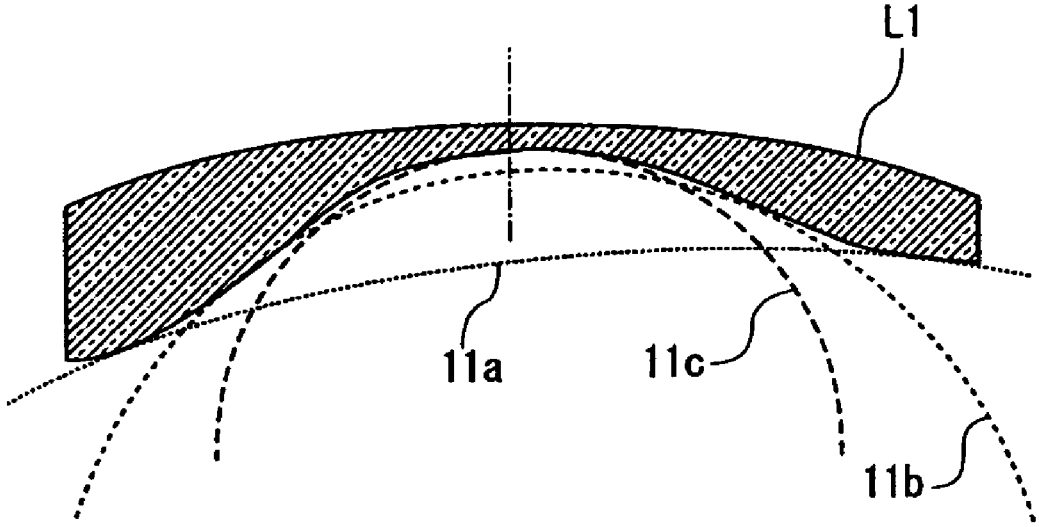
FIG. 2 is a general explanatory cross-sectional view showing a state of polishing a surface to be polished having a large difference in curvature by the use of three types of resilient abrasive members.

FIG. 2 is a cross-sectional view showing an example of an inner surface progressive multi-focal point lens including a progressive surface and a toric surface in combination. The inner surface progressive multi-focal point lens L1 is an example of a lens for correcting strong astigmatism, which is significantly different in curvature, being shown in similar figure to the actual lens. The central area of the concave surface exhibits the largest curvature (reciprocal of the radius of curvature), the outer peripheral area exhibits the smallest curvature, and the curvature at the intermediate portion exhibits a curvature in between.

In the polishing method of the present invention, a plurality of resilient abrasive members having the dome-shaped portions of different curvatures are selected according to the surface shape of the surface to be polished so that the surface to be polished is polished in two-stages, three-stages, or multi-stages including more than three stages. A method of selecting the resilient abrasive members that can be employed is to select three-phases of resilient abrasive members, including a dome-shaped portion 11*a* having a curvature close to the average curvature of the outer peripheral area of the inner surface of the lens L1, a dome-shaped portion 11*b* having a curvature close to the average curvature at the intermediate portion of the lens, and a dome-shaped portion 11*c* having a curvature close to the average curvature of the central area.

Accordingly, since the range of the curvature of the surface to be polished assigned to one resilient abrasive member is about one-third in comparison with the case in which a single resilient abrasive member is used for polishing the entire surface to be polished, the followability of the resilient abrasive members can sufficiently cover the surface to be polished, even those having significantly different curvatures, and hence an even polishing is achieved. Since even polishing is achieved, the polishing speed increases, and hence the total time required for polishing the entire surface can be reduced even when considering the time required for changing the resilient abrasive member.

In addition to the above-described surface including the progressive surface and the toric surface in combination, the concave surface including the portions of significantly different curvatures may have a significantly large addition power, which is the difference between powers of near and distance portion of a progressive multi-focal lens. In such a case, the difference between the curvatures of the distance portion and the near point are significantly large.

Various methods of selecting the resilient abrasive member are contemplated according to the shape of the surface to be polished. For example, there is a multi-stage polishing method including the steps of dividing the difference in curvatures between the largest curvature and the smallest curvature of the surface to be polished into a plurality of divisions, and selecting resilient abrasive members having the dome-shaped portions close to the average curvatures of the respective divided divisions.

There is also a method of selecting a resilient abrasive member having the dome-shaped portion of a curvature close to the largest curvature of the surface to be polished, a resilient abrasive member having the dome-shaped portion of a curvature close to the smallest curvature of the surface to be polished, and a resilient abrasive member having a dome-shaped portion of a curvature close to the average curvature between the largest curvature and the smallest curvature of the surface to be polished.

When the surface to be polished has a large curvature as a whole, the curvature of the dome-shaped portion of the resilient abrasive member to be selected increases. Therefore, the dome-shaped portion becomes small, and hence sufficient width of swinging motion cannot be secured in some cases. When the width of the swinging motion is not sufficient, the area near the top of the dome-shaped portion is kept in contact with the central area of the surface to be polished. Consequently, the polishing speed at the central area of the surface to be polished, which is kept in contact with the area near the top of the dome-shaped portion and is low in peripheral speed, is lowered, which may result in insufficient polishing at the central area of the surface to be polished.

In this manner, when polishing the concave surface of the lens, the central area of which can hardly be polished, a method of selecting the resilient abrasive member having the dome-shaped portion with a curvature close to the average curvature between the largest curvature and the smallest curvature of the surface to be polished, and selecting the resilient abrasive member having the dome-shaped portion close to the curvature at the central area of the surface to be polished in combination therewith may be employed.

Figure 3A:
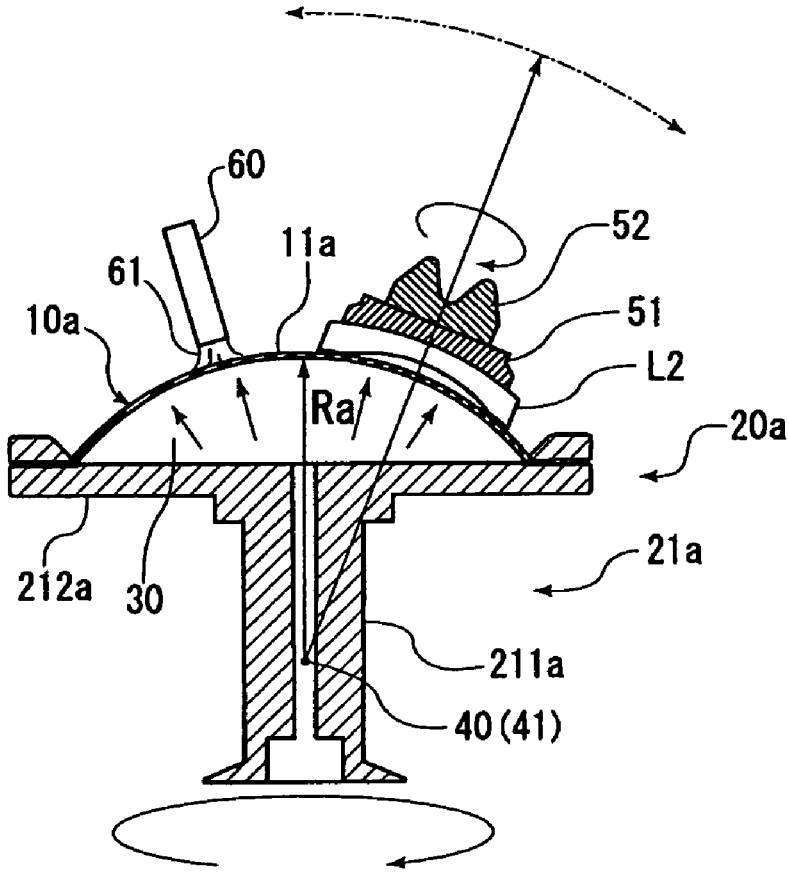
FIGS. 3A–3B are cross sectional views showing a polishing method according to an embodiment of the present invention, in which (a) shows an example of the resilient abrasive member having a small curvature, and (b) shows an example of the resilient abrasive member having a large curvature.
Figure 3B:
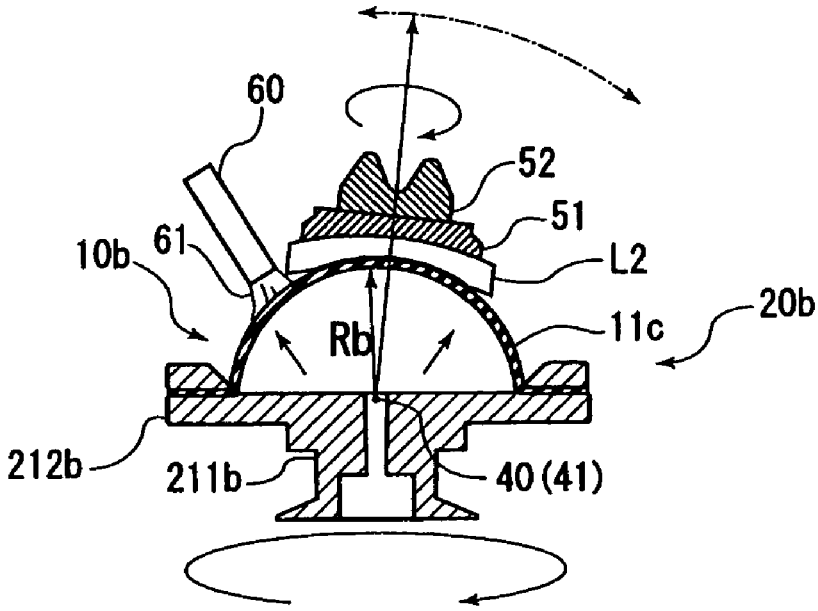

FIG. 3 is a cross-sectional view of a polishing method according to an embodiment of the present invention, showing a multi-stage polishing method including the steps of selecting a plurality of resilient abrasive members having the dome-shaped portions of different curvatures and replacing the resilient abrasive member in sequence for polishing, in which (a) shows an example of the resilient abrasive member having a small curvature, and (b) shows an example of the resilient abrasive member having a large curvature.

In the description in conjunction with FIG. 3, a case in which a concave surface of a spectacle lens L2 having a surface of small curvature in the outer peripheral area and a surface of large curvature in the central area is polished as a surface to be polished will be described.

As shown in FIG. 3(*a*), for example, a resilient abrasive member 10*a* having a dome-shaped portion 11*a* of small curvature (radius of curvature Ra is large) close to the smaller curvature in the outer peripheral area of the surface to be polished of the spectacle lens L2 is selected. As shown in FIG. 3(*b*), a resilient abrasive member 10*b* having a dome-shaped portion 11*c* of large curvature (radius of curvature Rb is small) close to the large curvature in the central area of the spectacle lens L2 is selected.

In the first step of the polishing process, as shown in FIG. 3(*a*), the resilient abrasive member 10*a* is attached to a specific abrasive member mounting jig 20*a*, the abrasive member mounting jig 20*a* is mounted to a rotating table of the polishing device that will be described later, compressed air of a predetermined pressure is supplied to a sealed space 30 between the inner surface of the dome-shaped portion 11*a* and the abrasive member mounting portion 212*a*, and the sealed space 30 is maintained at a predetermined pressure to provide tension to the dome-shaped portion 11*a*. The center of the curvature 40 of the dome-shaped portion 11*a* exists on the central axis of the cylindrical portion 211*a*. Then the resilient abrasive member 10*a* is rotated about the central axis of the cylindrical portion 211*a* of the abrasive mounting jig 20*a*, in other words, substantially about a line connecting the center of the curvature 40 of the dome-shaped portion 11*a* and the apex thereof.

A polishing target mounting portion 52 which is to be mounted and fixed to a chuck of the polishing device via a joining material 51 such as fusible metal or wax is joined to the surface to be polished of the polishing target L2 on the opposite side from the concave surface. The chuck, not shown, of the polishing device is rotated, and the polishing target L2 rotates about its own axis at a predetermined rotating speed. The chuck is adapted to have air pressure applied thereto so as to be capable of pressing the polishing target L2 against the resilient abrasive member 10*a* at a predetermined polishing pressure. In addition, the chuck for supporting the polishing target L2 of the polishing device performs such swinging motion that the axis of rotation of the polishing target L2 reciprocates between the portion near the apex and the end of the dome-shaped portion 11*a*. The center of swinging motion 41 substantially comes into alignment with the center of curvature 40 of the resilient abrasive member 11*a*. The axis of rotation of the chuck supporting the polishing target L2 always passes through the center of swinging motion 41.

The swinging motion may be such that the surface to be polished and the resilient abrasive member move with respect to each other, and is not limited to the swinging motion of the chuck but may be swinging motion of the resilient abrasive member.

When polishing, as shown in FIG. 3(*a*), the resilient abrasive member 10*a* on which the abrasive pad 13 (See FIG. 1) is adhered on the surface thereof has a tension applied thereto at a predetermined internal pressure and is rotated at a predetermined rotary speed about its own axis, while the polishing target L2 is pressed against the resilient abrasive member 10*a* with a predetermined polishing pressure while being rotated at a predetermined rotary speed about an axis passing through the center of curvature (center of rotation) 40 and, at the same time, the polishing target L2 is swung while supplying slurry 61 containing abrasive material onto the surface of the resilient abrasive member 10*a* from a nozzle 60.

In this case, polishing can be carried out under such conditions that the internal pressures to be applied to the resilient abrasive members 10*a*, 10*b* are, for example, 0.2–1.2 kgf/cm$^2$, the rotary speeds of, the resilient abrasive members 10*a*, 10*b* are, for example, 50–500 rpm, the rotary speed of the polishing target L2 is, for example, 1–30 rpm, the swinging speed is, for example, 1–20 to and fro/min., and the polishing pressure is, for example, 3–30 kgf/cm$^2$.

In the first stage of the polishing process, the surface having a small curvature in the outer peripheral area of the surface to be polished of the polishing target L2 is mainly polished by the resilient polishing member 10*a*.

Subsequently, in the second stage of the polishing process, as shown in FIG. 3(*b*), the resilient abrasive member 10*b* is mounted to the abrasive member mounting portion 121*b* of the specific abrasive member mounting jig 20*b*, and polishing is carried out as in the first step of the polishing process. In the second step of the polishing process as well, the center of swinging motion 41 of the polishing target L2 substantially comes into alignment with the center of the curvature 40 of the dome-shaped portion 11*c* of the resilient abrasive member 10*b*. In other words, as shown in FIG. 3, the lengths of the cylindrical portions 211*a*, 211*b* of the abrasive member mounting jigs 20*a*, 20*b* are determined so that the center of curvature 40 of the dome-shaped portions 11*a*, 11*c* always comes into alignment with the center of swinging motion 41 when the abrasive member mounting jigs 20*a*, 29*b* are mounted to the polishing device, and the heights at which the resilient abrasive members 10*a*, 10*b* are held can be changed in the vertical direction. Since the center of swinging motion 41 aligns substantially with the center of curvature 40 of the dome-shaped portions 11*a*, 11*c* of the resilient abrasive members 10*a*, 10*b*, and the relative distance between the surface to be polished and the resilient abrasive members 10*a*, 10*b* is held constant, the surface to be polished is always kept in even contact with the surfaces of the resilient abrasive members 10*a*, 10*b*, and hence even polishing is achieved.

In the second stage of the polishing process, the curvature in the central area of the surface to be polished of the polishing target L2 is mainly polished by the resilient abrasive member 10*b* of large curvature.

With such a multi-stage polishing method, even when the surface to be polished of the polishing target L2 has portions of significantly different curvatures, more even and quicker polishing in comparison with the case of polishing with a single type of the resilient abrasive member by polishing the surface of large curvature in the central area with the resilient abrasive member 10*b* having the dome-shaped portion 11*c* close to the curvature thereof, and polishing the surface of small curvature in the outer peripheral area with the resilient abrasive member 10*a* having the dome-shaped portion 11*a* close to the curvature thereof. It is also possible to change the resilient abrasive member from the first stage of the polishing process to the second stage of the polishing process and polish the central area of the surface to be polished in the first stage of the polishing process and the outer peripheral area of the surface to be polished in the second stage of the polishing process. The order of the polishing procedure is not limited in the multi-stage polishing method of the present invention.

Figure 4A:
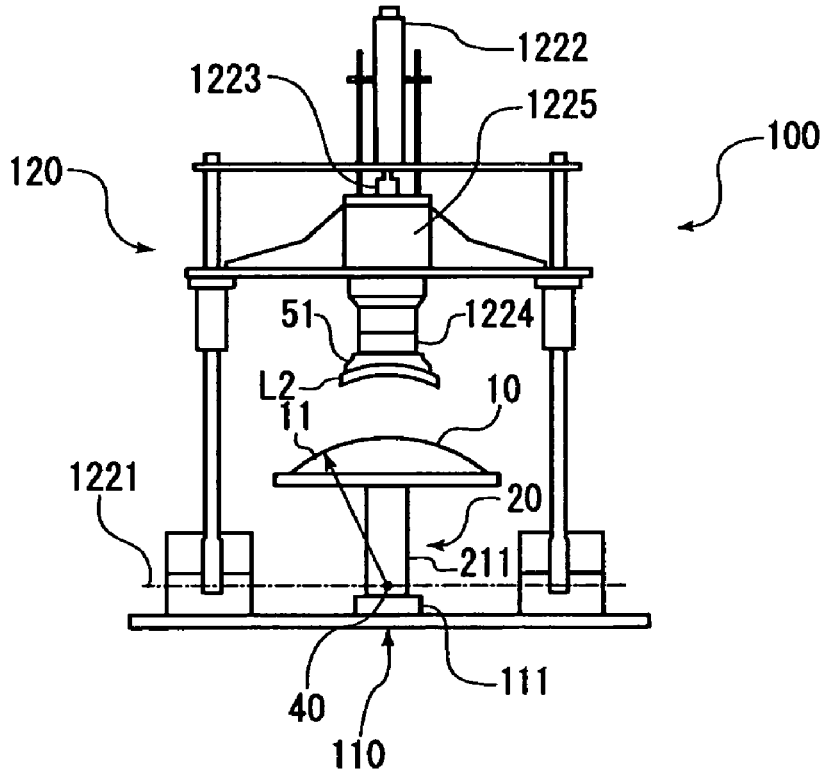
FIGS. 4A–4B show a polishing device according to an embodiment of the present invention in which (a) is a front view, and (b) is a side view.
Figure 4B:
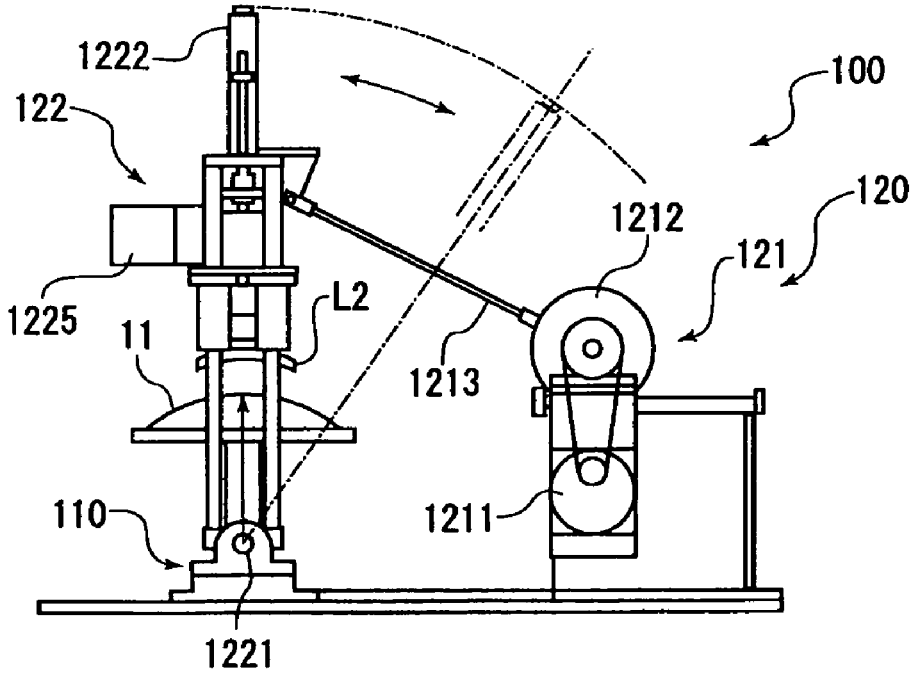

Referring to FIG. 4, a polishing device which can implement the polishing method of the present invention will be described. FIG. 4(*a*) is a front view of the polishing device, and FIG. 4(*b*) is a side view.

The polishing device 100 includes an abrasive member holding drive 110, the abrasive member mounting jig 20, and a polishing target holding drive 120. The abrasive member holding drive 110 includes a rotating table 111 which is rotated about the vertical axis by a motor, not shown, so that the mounting portion 2111 (See FIG. 1) at the lower end of the cylindrical portion 211 of the abrasive member mounting jig 20 is detachably attached to the rotating table 111. The abrasive member mounting jig 20 can be rotated at a predetermined rotary speed substantially about a central axis of the cylindrical portion 211, that is, about a line connecting the center of curvature 40 of the dome-shaped portion 11 of the resilient abrasive member and the apex of the dome-shaped portion 11 by mounting the abrasive member mounting jig 20 to the rotating table 111. Also, piping for compressed air, not shown, is provided on the rotating table 111 so as to be connected with the hollow portion of the cylindrical portion 211.

Furthermore, a swinging unit 121 and a polishing target holding unit 122 which is swung by the swinging unit 121 are provided as the polishing target holding drive 120. The swinging unit 121 drives a crank 1212 which is rotated by a motor 1211 via a belt transmission, and swings the polishing target holding unit 122 which is connected to the crank 1212 via a connecting rod 1213. The polishing target holding unit 122 is adapted to be capable of swinging in the fore-and-aft direction between the vertical direction and the inclined angle on the back side about the swinging axis 1221. The polishing target holding unit 122 is provided with an air cylinder 1222 facing vertically downward on top thereof, and a chuck 1224 to which the polishing target mounting portion 52 (See FIG. 3) is mounted and fixed is provided at the extremity of a piston rod 1223 of the air cylinder 1222. The chuck 1224 is rotated about the axis passing through the intersection between the swinging axis 1221 and the center axis of the cylindrical portion 211 of the abrasive member mounting jig 20 by a motor 1225. The polishing target L2 can be mounted to the polishing target holding unit 122 by mounting the polishing target mounting portion 52, integrally formed with the polishing target L2 via the joining material 51, to the chuck 1224. The mounted polishing target L2 can be moved toward and away from the resilient abrasive member 10 by the air cylinder 1222, and is adapted to be pressed against the resilient abrasive member 10 with a predetermined polishing pressure.

The polishing device 100 is configured in such a manner that when the abrasive member mounting jig 20 with the specific cylindrical portion 211 having a length corresponding to the curvature of the dome-shaped portion 11 of the resilient abrasive member 10 is mounted to the rotating table 111, the holding positions of the resilient abrasive member 10 are different for the respective resilient member mounting jigs 20, and the center of curvature 40 of the dome-shaped portion 11 of the resilient abrasive member 10 aligns substantially with the center of the swinging axis 1221.

In such a polishing device 100, for example, when polishing the concave surface of the lens as the polishing target L2, the resilient abrasive member 10 having the abrasive pad 13 adhered on the surface thereof is rotated about its own axis at a predetermined rotary speed on the rotating table 111 while providing tension thereto with a predetermined internal pressure by adjusting the pressure of the compressed air, and simultaneously, the polishing target L2 is pressed against the resilient abrasive member 10 With a predetermined polishing pressure of the air cylinder 1222 while rotating the polishing target L2 about its own axis at a predetermined rotary speed, and the polishing target L2 is swung by the swinging unit 121 while supplying slurry containing abrasive material from the nozzle, not shown, to the surface of the resilient abrasive member 10.

The polishing device 100 as described above is configured in such a manner that the center of curvature of the dome-shaped portion 11 aligns substantially with the center of swinging motion 1221 of the polishing targets even when the resilient abrasive member 10 is replaced with that having the dome-shaped portion 11 of a different curvature. Therefore, even and quick polishing is achieved by the swinging motion of the polishing target L2, which enables effective usage of the surfaces of the resilient abrasive members 10.

The invention claimed is:

1. A polishing method for a polishing target having a plurality of surface portions of different curvatures using resilient abrasive members each having a dome-shaped portion, the resilient abrasive members being of a plurality of types having the dome-shaped portions of different curvatures, comprising the steps of:

selecting more than two of the resilient abrasive members according to the surface shape of the surface to be polished and having a plurality of surface portions of significantly different curvatures; and polishing the surface to be polished having plurality of surface portions of significantly different curvatures by the use of the selected resilient abrasive members, wherein the plurality of resilient abrasive members each is assigned to one of a plurality of divisions corresponding to the predetermined curvatures, and the step of selecting includes selecting a resilient abrasive member having a curvature which corresponds to the curvature of the assigned division prior to the step of polishing a curvature of the surface to be polished having a plurality of surface portions of significantly different curvatures;

and the plurality of divisions are provided by dividing the surface to be polished having a plurality of surface portions of significantly different curvatures, having the plurality of curvatures according to the curvature ranging from the largest curvature to the smallest curvature.

2. A polishing method according to claim 1, characterized in that the step of selecting comprises selecting resilient abrasion members having the dome-shaped portions of curvatures close to the average curvature of the respective divisions of the surface to be polished of a plurality of curvatures, which are divided according to the curvature ranging from the largest curvature to the smallest curvature.

3. A polishing method according to claim 1, characterized in that the step of selecting comprises selecting a resilient abrasive member having the dome-shaped portion of curvature close to the largest curvature of the surface to be polished, a resilient abrasive member having the dome-shaped portion of a curvature close to the smallest curvature of the surface to be polished, and a resilient abrasive member having the dome-shaped portion of curvature close to the average curvature between the largest curvature and the smallest curvature of the surface to be polished.

4. A polishing method according to claim 1, characterized in that the step of selecting comprises selecting resilient abrasive members having the dome-shaped portions of curvatures close to the curvature of the central area of the surface to be polished.

5. A polishing method according to claim 1, characterized in that the step of polishing comprises polishing while rotating a polishing target and the resilient abrasive member about their own axes, swinging the polishing target and the resilient abrasive member with respect to each other until substantial alignment of the center of curvature of the dome-shaped portion with the center of swinging motion of the polishing target is achieved.

6. A polishing method according to claim 1, characterized in that the dome-shaped portion of the resilient abrasive member is formed of a resilient sheet into a hollow dome shape, and the step of polishing comprises polishing while applying pressure to the inner surface of the resilient sheet with a pressurized fluid injected into the hollowed portion to provide tension to the dome-shaped portion.

* * * * *